US010573140B2

(12) United States Patent
Diplock et al.

(10) Patent No.: US 10,573,140 B2
(45) Date of Patent: Feb. 25, 2020

(54) WALLET ALARM

(71) Applicant: Control Group Companies, LLC, Cranford, NJ (US)

(72) Inventors: Brian Mark Diplock, Scotch Plains, NJ (US); Thomas John Meehan, Union City, NJ (US)

(73) Assignee: Control Group Companies, LLC, Cranford, NJ (US)

( * ) Notice: Subject to any disclaimer, the term of this patent is extended or adjusted under 35 U.S.C. 154(b) by 0 days.

(21) Appl. No.: 16/016,153

(22) Filed: Jun. 22, 2018

(65) Prior Publication Data

US 2018/0374323 A1 Dec. 27, 2018

Related U.S. Application Data

(60) Provisional application No. 62/524,150, filed on Jun. 23, 2017.

(51) Int. Cl.
*G08B 13/14* (2006.01)
*G08B 13/02* (2006.01)

(52) U.S. Cl.
CPC ..... *G08B 13/02* (2013.01)

(58) Field of Classification Search
CPC .... G08B 13/02; G08B 21/24; G08B 13/2445; G08B 3/10; G08B 13/1454; G08B 13/06; G08B 5/36; G08B 13/149
USPC ..... 340/568.7
See application file for complete search history.

(56) References Cited

U.S. PATENT DOCUMENTS

| | | | | |
|---|---|---|---|---|
| 3,930,249 | A | 12/1975 | Steck et al. | |
| 5,379,024 | A * | 1/1995 | Hsu | A45C 13/185 200/61.42 |
| 5,647,106 | A | 7/1997 | Hogan | |
| 5,790,027 | A | 8/1998 | Chern | |
| 6,049,277 | A * | 4/2000 | Osame | A45C 13/24 340/568.7 |
| 7,474,209 | B2 | 1/2009 | Marsilio et al. | |
| 9,165,447 | B2 * | 10/2015 | Jenkins | G08B 13/1427 |
| 2006/0220457 | A1 * | 10/2006 | Yabumoto | B60R 25/02153 307/10.2 |
| 2014/0071643 | A1 | 3/2014 | Yang | |
| 2014/0077954 | A1 * | 3/2014 | Luo | G08B 13/2434 340/572.8 |

FOREIGN PATENT DOCUMENTS

| | | | |
|---|---|---|---|
| CN | 202603870 U | * | 12/2012 |
| DE | 3043152 A1 | | 9/1981 |

OTHER PUBLICATIONS

Partial Search Result including Provisional Opinion for PCT/US2018/039280 dated Sep. 21, 2018.

* cited by examiner

*Primary Examiner* — Tanmay K Shah
(74) *Attorney, Agent, or Firm* — Lerner, David, Littenberg, Krumholz & Mentlik, LLP

(57) ABSTRACT

A security device for use with an item of merchandise may include a rigid housing adapted for insertion into a pocket of the item, an alarm disposed within the housing, and a sensor mounted to the housing. The sensor may be configured to indicate whether the security device is outside the pocket of the item, whereby an indication that the security device is outside the pocket of the item causes the alarm to generate a human-perceptible alert.

20 Claims, 6 Drawing Sheets

WALLET ALARM

CROSS-REFERENCE TO RELATED APPLICATION

The present application claims the benefit of the filing date of U.S. Provisional Patent Application No. 62/524,150 filed Jun. 23, 2017, the disclosure of which is hereby incorporated herein by reference.

FIELD OF THE INVENTION

The present disclosure relates to security systems, and particularly to security systems including electronic article surveillance (EAS) tags, for use in shoplifting deterrence, internal theft deterrence, and inventory control generally in a retail establishment.

BACKGROUND OF THE INVENTION

EAS tags and other security devices are used as a means of deterring both internal and external theft in retail establishment settings, such as brick-and-mortar stores. A store equipped with an EAS system generally includes several EAS gates or pedestals positioned at the exits of the store. Each of the gates has an audible alarm that sounds when an EAS tag exits the store through the gate. The EAS tags are typically affixed to an article of clothing or other retail item, and are designed to be removed only by a specialized device that should only be in the possession of store personnel at the checkout counter or other locations before the customer exits the store.

EAS tags and other security devices are typically designed in such a way that the security device cannot be easily removed, or at least appears to be difficult to remove. In this manner, a would-be thief is deterred from stealing the item, since the security device would set off the gate alarm if not removed, and cannot be easily removed (or at least appears to be difficult to remove). There are several different ways to deter removal of a security device. Some devices include ink that is released if an attempt is made to remove the device from the item to which the device is attached, thereby permanently destroying the item. Other devices are anchored or attached to an item in a way that would or could cause damage to the item if removed incorrectly. These security features are sometimes referred to as "benefit denial."

One of the disadvantages of benefit denial security devices is that the item to which the security device is attached may be permanently damaged even if the security device is only inadvertently activated. Additionally, in some cases, a thief may attempt to steal the item, and either is unaware of or indifferent to the potential damage caused to the item. Thus, benefit denial security devices may result in undesired retail losses for the retailer.

Additionally, EAS tags are not easily applied in an effective manner to all types of products. One type of product that generally has been difficult to protect with an EAS tag is wallets. The devices disclosed herein address that difficulty.

BRIEF SUMMARY OF THE INVENTION

The present disclosure provides a security device that does not damage an item if improperly removed from the item, yet still effectively deters theft of the item. This is accomplished by inserting the security device into a pocket of the item, clipping the security device to the item, or both, in a manner that does not puncture or otherwise cut into the material of the item. In this manner, even if the security device is improperly removed from the item, the item will not be damaged. To deter removal of the device, the device includes a input module which detects removal of the device from a secured item, and a built-in alarm which is activated in response to the detected removal.

In some examples, the security device is a "two-alarm" device, meaning that the device is capable of setting off two different alarms if an attempt is made to steal the item to which the device is attached. For example, a first alarm may be an EAS component included in the device, which as explained above, is capable of setting off a security gate stationed at an exit of the store. The second alarm may be the aforementioned input module and built-in alarm, which deters removal of the device from the secured item.

According to one aspect of the disclosure, a security device for use with an item of merchandise includes a rigid housing having a top cover and a bottom cover and adapted for insertion into a pocket of the item, an alarm disposed within the housing and configured to generate a human-perceptible alert, and an input module mounted to the housing and configured to indicate whether the security device is outside the pocket of the item. An indication that the security device is outside pocket of the item may cause the alarm to generate the human-perceptible alert.

According to another aspect of the disclosure, a security device for use with an item of merchandise includes a rigid housing, a clip mounted on the housing, an alarm disposed within the housing, and an input module disposed within the housing. The housing may have a front cover and a back cover, and the back cover may include an aperture therethrough. The clip may be mounted on the back cover and adapted to secure the security device to the item of merchandise by engaging the item of merchandise between the clip and the back cover. The clip may include an aperture aligned with the aperture in the back cover. The alarm may be configured to generate a human-perceptible alert. The input module may be aligned with the aperture in the back cover, and may be configured to indicate whether the item of merchandise is unsecured from the security device, whereby an indication that the item of merchandise is unsecured from the security device may cause the alarm to activate According to yet another aspect of the disclosure, a security device for use with an item of merchandise include a housing having a top cover and a bottom cover, a printed circuit board mounted within the housing, an aural alarm mounted on the printed circuit board, a transformer mounted on the printed circuit board and operatively coupled to the aural alarm to power the aural alarm, a visual alarm mounted on the printed circuit board, and a battery mounted on the printed circuit board. The battery may be operatively coupled to the transformer and the visual alarm, and may be adapted to generate sufficient charge to power both the aural alarm and the visual alarm. The security device may also include a trigger module mounted on the printed circuit board and including a casing and a spring-loaded trigger enclosed within the casing. The spring-loaded trigger may close an electrical switch when the spring is in a compressed condition and may cause the electrical switch to open when the spring is in a relaxed condition. The trigger may retract into the casing when the spring is in the compressed condition and may extend out from the casing when the spring is in the relaxed condition. The security device may also include an integrated circuit mounted on the printed circuit board and operatively coupled to the electrical switch to cause activation of the aural alarm and the visual alarm in response to respond to closing or opening of the electrical switch. The security device may also include an arming mechanism movable between an arm position and a disarm position, and a locking mechanism disposed within the housing. The locking mechanism may have a first condition in which the locking mechanism locks the arming mechanism in the arm position and a second condition in which the locking mechanism releases the arming mechanism to move from the arm position to the disarm position. The integrated circuit being capable of causing activation of the aural alarm and the visual alarm only if the arming mechanism is in the arm position. The security device may also include an electronic article surveillance (EAS) component disposed within the housing and configured to activate a security gate alarm when the device is within a predefined proximity of a security gate.

DETAILED DESCRIPTION

As used herein, the terms "generally," "substantially," "approximately," and "about" are intended to mean that slight deviations from absolute are included within the scope of the term so modified.

Figure 1A:
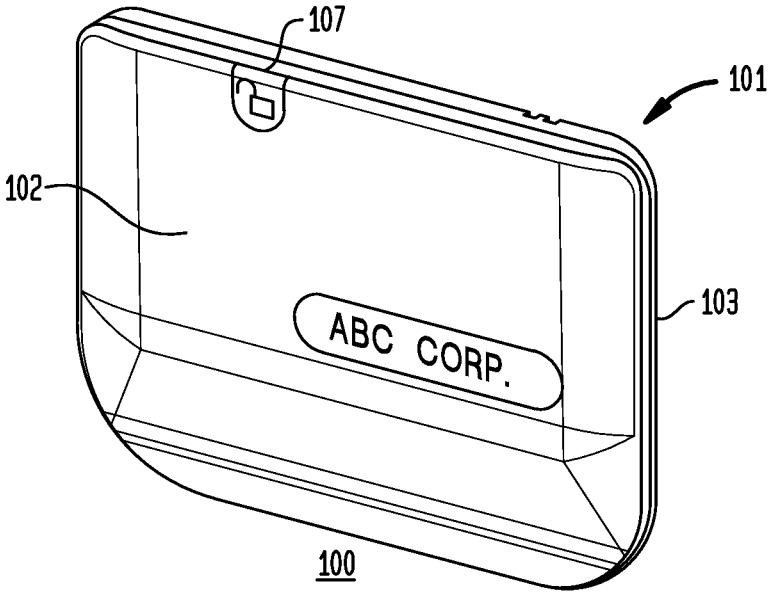
FIGS. 1A and 1B are front and back perspective views, respectively, of a security device in accordance with an aspect of the disclosure.
Figure 1B:
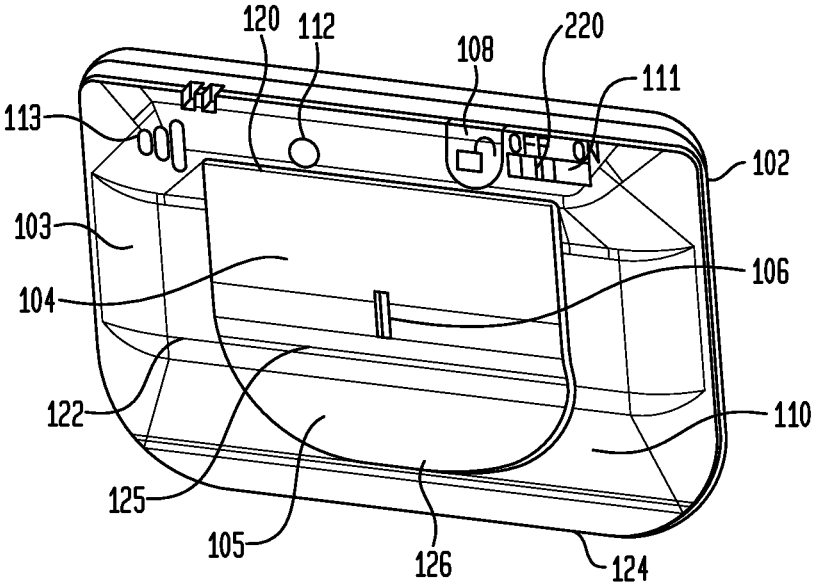

FIGS. 1A and 1B are front and back perspective views, respectively, of a security device 100 according to the present disclosure. Security device 100 has a rigid housing 101, which may include at least a front or top cover 102 and a back or bottom cover 103. The covers may be attached to one another using any one or a combination of mechanisms known in the art, such as a press fitting, snap fitting, screw locking, welding, adhesives and the like.

The device 100 may further include a clip 104 mounted to an outer surface of the back cover 103 at an attached end 120 of the clip. The clip 104 may be roughly parallel with the outer surface of the back cover 103, and may be adapted to press against the back cover, such that an item of merchandise may be firmly clipped to the device 100 between the clip and the back cover. As shown in FIGS. 1B and 4B, a portion 110 of the back cover 103 from an intermediate location 122 to a longitudinal edge 124 tapers to a smaller thickness. An intermediate portion 125 of the clip 104 may bend toward the back cover 103 until it contacts or almost contacts the back cover at intermediate location 122. From this point to its free end 126, the clip 104 may curl away from the back cover 103. A small aperture 106 is centered at a midpoint of the clip 104.

The housing 101 may include various indicia. Some indicia may be included for aesthetic purposes (e.g., a trademark or other words on the front cover 102), whereas other indicia may have a functional purpose (e.g., "ON/OFF" indicia on back cover 103, or "unlock" indicia 107, 108 on both the front and back covers, respectively).

The housing 101 may also include various openings to facilitate its operation. For example, FIG. 1B depicts a power switch opening 111 provided to enable direct manipulation of a power switch 220 disposed within the housing 101, a light opening 112 to enable light from a visual alarm (e.g., light emitting diode 285) to be emitted from within the housing, and sound openings 113 to enable sound from an aural alarm (e.g., buzzer 280) to be emitted from within the housing.

Figure 2:
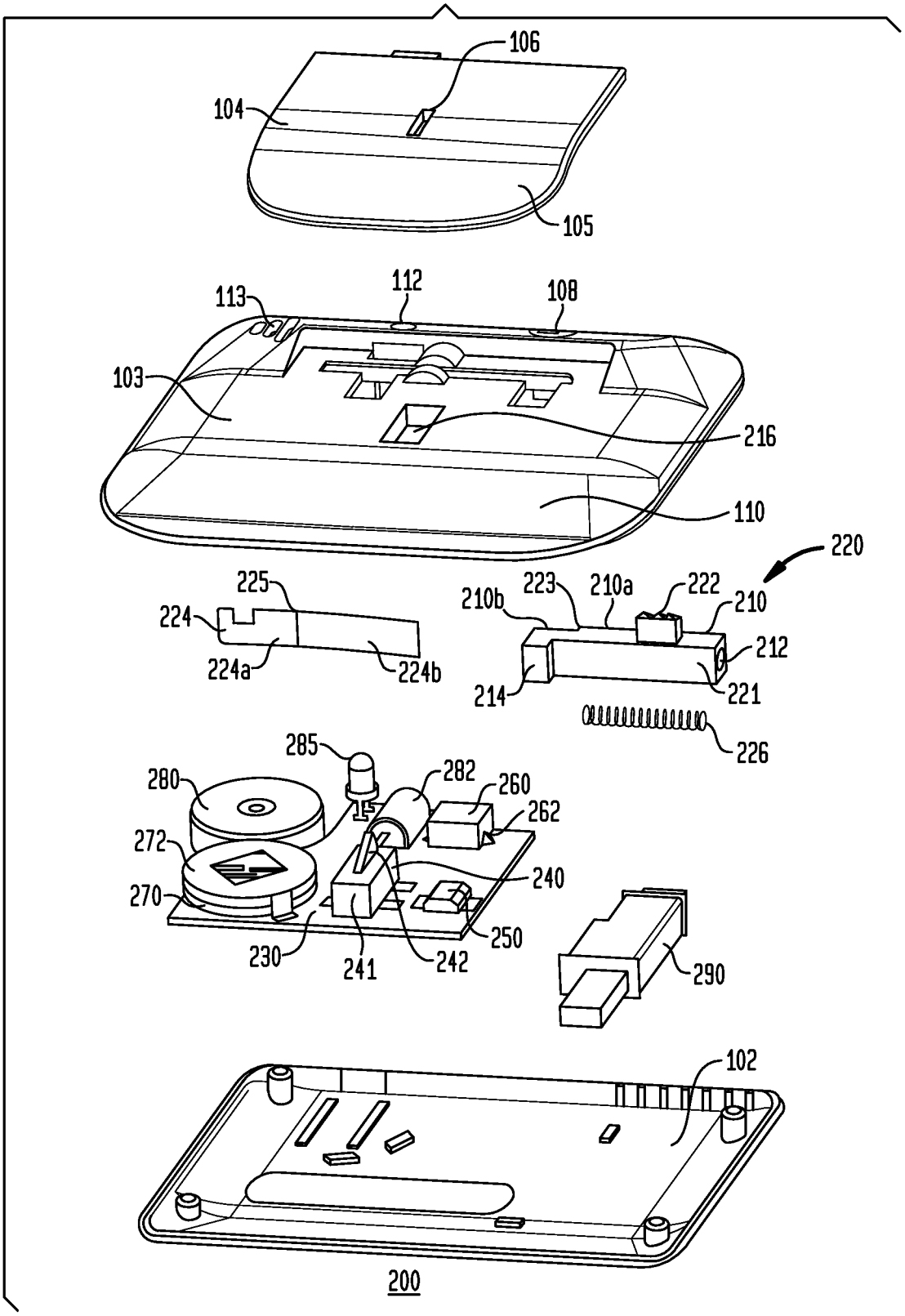
FIG. 2 is an exploded schematic view of the security device of FIGS. 1A and 1B.

FIG. 2 is an exploded view of security device 100, including the components contained within the housing 101. An aperture 216 positioned at a midpoint of the back cover 103 above tapered portion 110 is aligned with the aperture 106 of the clip 104. These apertures are further aligned with an input module disposed within the housing 101 (e.g., a microswitch, pressure sensor or light sensor, described in greater detail below), and thereby provide an opening by which the input module may operatively sense an activity taking place external to the device housing, such as the security device 100 being unclipped from an item of merchandise.

The power switch 220 may comprise a body 221 disposed within the housing 101 and a slide 222 attached to the body 221 and protruding from the housing through the power switch opening 111. The power switch 220 may be moveable between two positions: a first armed position in which the security device 100 is armed or activated (i.e., "on"), and a second unarmed or disarmed position in which the security device is disarmed or deactivated (i.e., "off").

The security device 100 may further include a finger 224 formed from a thin strip of spring metal. Finger 224 is disposed within the housing 101 so that one end portion 224*a* thereof is held in a fixed position. The finger 224 is bent at crease 225 so that the other end portion 224*b* of the finger is biased against a surface 210 of the switch body 221. The surface 210 includes a first portion 210*a* toward the right (as seen in FIG. 2) of the switch body 221 and a recessed portion 210*b* toward the left (as seen in FIG. 2) of the switch body so that an edge 223 is created between the first portion and the recessed portion. When the power switch 220 is in the disarmed position (i.e., to the left in FIG. 2), the end portion 224*b* of the finger 224 rests against the first portion 210*a* of the surface 210. When the power switch 220 is moved to the armed position (i.e., to the right in FIG. 2), the end portion 224*b* of the finger 224 slides along the first portion 210*a* of the surface 210 until it reaches the edge 223, at which point it is biased into the recessed portion 210*b*. Once in this position, the engagement of the free end of the finger 224 with the edge 223 will lock the power switch 220 in place, preventing it from moving back to the disarmed position. The finger 224 may be adapted to disengage from the recessed portion 210*b* of the switch body 221 when an external force is exerted on the finger to bend it away from the recessed portion. Since the finger 224 is fully disposed within the device housing 101, it cannot be manipulated directly by hand (as with the power switch 220). Instead, a magnet may be used to attract the end portion 224*b* of the finger 224 in a direction away from the recessed portion 210*b* of the switch body 221. Once the finger 224 is disengaged from the recessed portion 210*b*, the power switch 220 may again be moveable, and a force may be exerted on the power switch to move it from the armed position to the disarmed position. The force may be from a person pushing the slide 222, from a compression spring 226 having one end assembled in a blind hole 212 in an end of switch body 221 and the other end engaged with an internal feature of housing 101 so as to urge the power switch 220 to the unarmed position, or both.

The security device 100 may include additional components arranged on a printed circuit board 230 mounted within the housing 101. Such components may include an input module 240, an integrated circuit 250, a power switch module 260, a disc battery 270, an aural alarm 280 (such as a buzzer), a transformer 282 for powering the aural alarm, and a visual alarm 285 (such as an LED).

The input module 240 may include a microswitch including a casing 241 and a trigger 242 partially projecting out of the casing in a direction toward the back cover 103 of the housing 101. The trigger 242 is aligned with the aperture 216 in the back cover 103, and a trigger spring (not shown) enclosed within the casing 241 is adapted to bias the trigger at least partially through the casing 241 and at least partially through the aperture 216. The microswitch may be closed when the force exerted by the trigger meets or exceeds a threshold amount, and may be open when the force is below the threshold amount, or vice versa. For example, the microswitch may be closed when the trigger 242 protrudes fully from casing 241, and may be open when the trigger is depressed into the casing.

The integrated circuit 250 may be operatively coupled to the input module 240 to respond to the input. For instance, the integrated circuit 250 may respond to closure of the microswitch. The integrated circuit 250 may further be operatively coupled to the aural alarm 280 and to the visual alarm 285 to cause the alarms to be activated (e.g., the buzzer to ring, the LED to illuminate) in response to the input.

The switch body 221 may be adapted to contact the power switch module 260 in the armed or on position but not in the disarmed or off position, or vice versa. In this regard, the power switch module 260 may be controlled based on contact with an enlarged end 214 of the switch body 221, and may control the provision of power to the integrated circuit 250, to the alarms 280, 285, or to all of these components.

The battery 270 provides power to the integrated circuit 250 and the alarms 280, 285, and in some embodiments may also power the input module 240. In the example of FIG. 2, the battery 270 is a lithium coin battery (e.g., CR1632). The battery may last for about two or more years in standby (powering the integrated circuit but not activating the alarm). The battery may be mounted to the printed circuit board 230 and held in place by a clip 272.

Although security device 100 has been described as including a buzzer, a transformer for powering the buzzer, and an LED, in other embodiments, the device may include other types of alarms, such as an electronic speaker or electronic display. In yet further examples, the security device may include a transmitter to transmit an alarm signal to a remote alarm (e.g., an in-store security alarm, a security desk alarm, a mobile alarm device for security personnel, etc.), thereby setting off the remote alarm.

The security device 100 may further include an EAS component 290 disposed within the housing 101. The EAS component 290 may be configured to activate a remote alarm, such as a security gate alarm remote from the security device 100, when the device is within a predefined proximity of a corresponding security gate or passes through the gate. The EAS component 290 may be an AM, EM ferrite, RF, RFID inlay, or a hybrid combination thereof, or any other component known in the art for activating a remote alarm.

The EAS component 290 may not be operatively coupled to the integrated circuit 250 or any other component housed within the security device 100. However, in other embodiments, the EAS component 290 may be coupled thereto. For example, an EAS component may be connected to the integrated circuit, and may provide one or more electrical signals to the integrated circuit when the device passes through a security gate.

Figure 3:
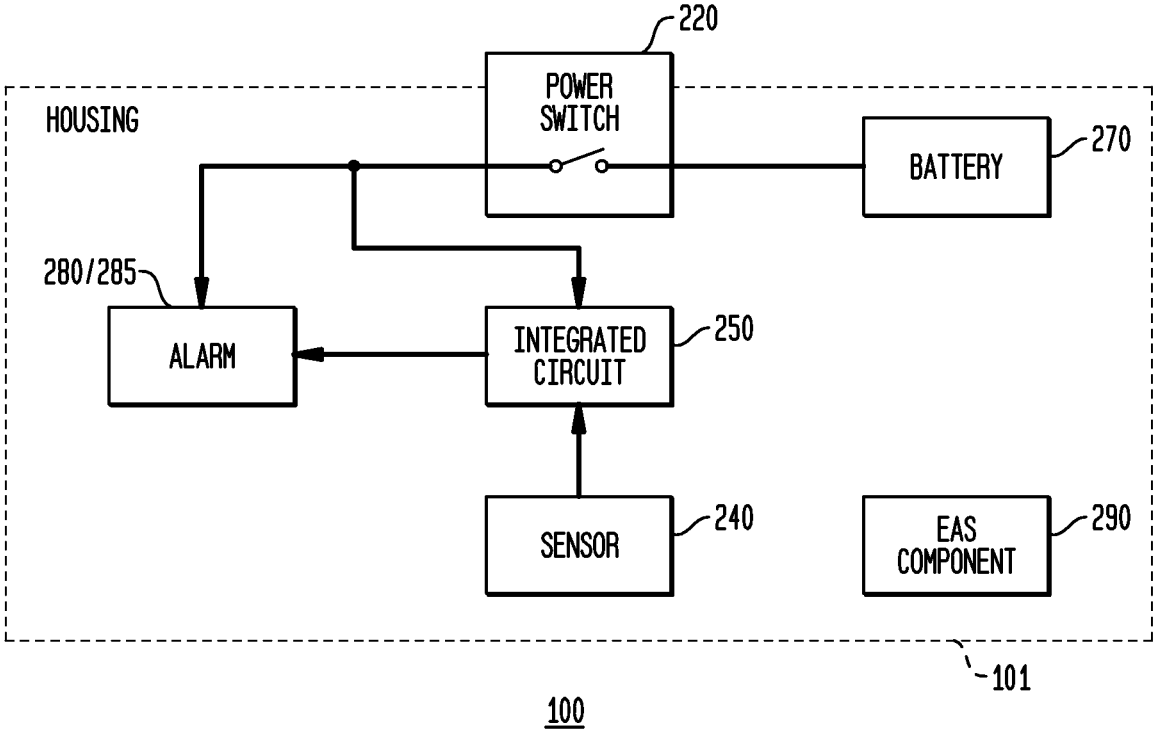
FIG. 3 is a functional block diagram in accordance with an aspect of the disclosure.

FIG. 3 is a functional block diagram illustrating the operation of security device 100. The battery 270 is operatively connected to the integrated circuit 250 and alarm(s) 280/285 through power switch 220. When power switch 220 is in the armed or on position, the battery 270 is connected and provides power to both the integrated circuit 250 and alarm(s) 280/285. Conversely, when power switch 220 is in the disarmed or off position, the connection (and thereby power) is cut off.

The integrated circuit 250 responds to the input at the input module 240, and controls the alarm(s) 280/285 in response thereto. For example, the integrated circuit 250 may respond to the closing or opening of an electrical circuit caused by a microswitch at the input module 240. Controlling the alarm(s) 280/285 may involve causing the alarm(s) to actuate in response to the closing or opening of the electrical circuit. Other security device embodiments may be designed to provide direct communication between the input module 240 and the alarm(s).

In the embodiment of FIG. 3, the input module 240 does not receive power from the battery 270. However, in other embodiments, the input module 240 may require power to operate, and may receive the required power from the battery 270.

Figure 4A:
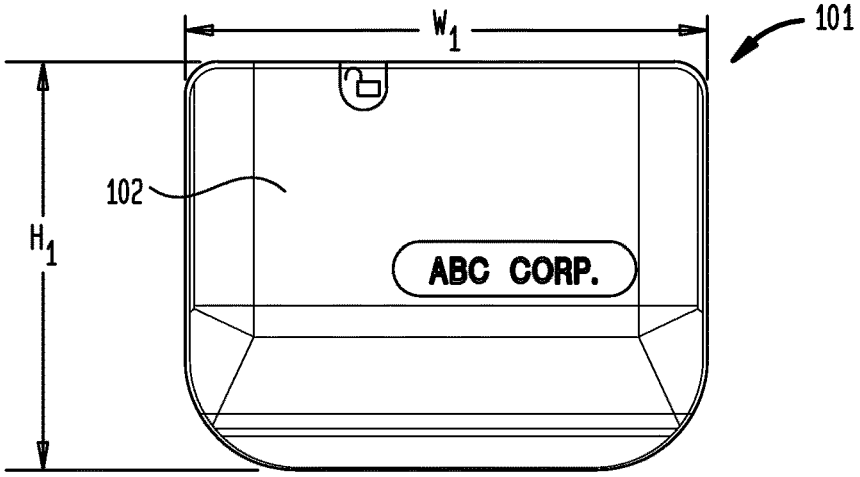
FIGS. 4A, 4B and 4C are front, side and back views, respectively, of the security device of FIGS. 1A and 1B, depicting certain measurements thereof.
Figure 4B:
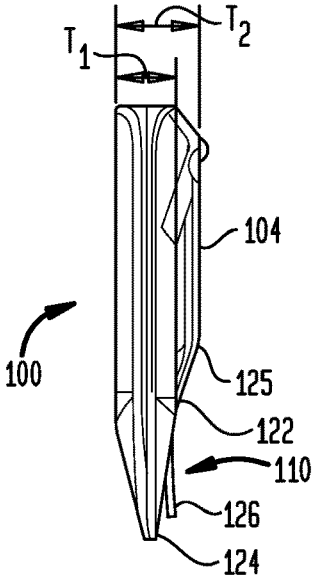
Figure 4C:
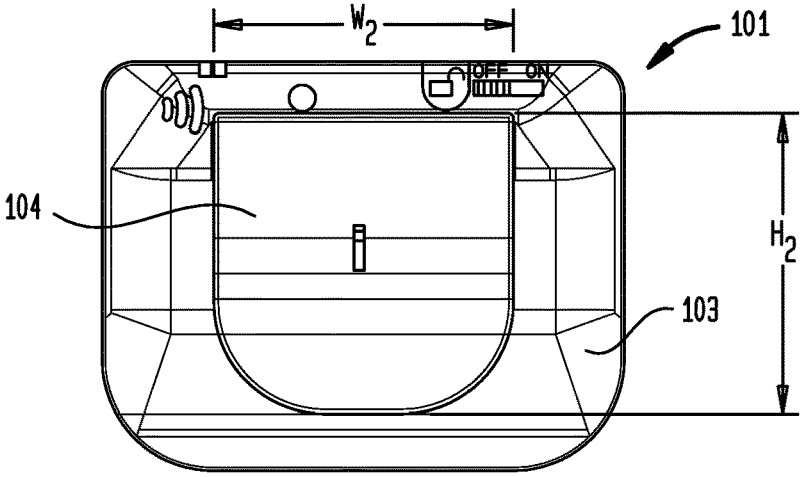

FIGS. 4A, 4B and 4C depict the measurements of an embodiment of the security device 100 described herein. The security device 100 is specially designed to fit into a sleeve or pocket of a wallet or other card-holding accessory. Cards (e.g., business cards, credit cards) are typically about 89 millimeters wide by about 57 millimeters high or smaller. Therefore, in order for the security device 100 to fit into a typical sleeve, it may be designed to have dimensions that do not exceed a width $W_1$ of about 90 millimeters and a height $H_1$ of about 60 millimeters. For example, security device 100 may have a width $W_1$ of about 70 millimeters and height $H_1$ of about 55 millimeters. Additionally, in order for the security device 100 not to stretch out the typical card sleeve, its housing 101 must be thin enough to comfortably fit in the card sleeve, generally not exceeding a thickness $T_1$ of about 10 millimeters. For example, the housing 101 of the security device 100 may have a thickness $T_1$ of about 7 millimeters. Including the clip 104, which is designed to be positioned outside the sleeve or pocket when properly positioned relative to same, the security device 100 may have a thickness $T_2$ of about 9.5 millimeters. In a further example, the clip 104 may have a width $W_2$ of about 40 millimeters and a height $H_2$ of about of 40 millimeters. Other devices may be designed with larger or smaller dimensions to be accommodated in different sized sleeves and pockets. One constraint is that the clip's width $W_2$ should not exceed the width $W_1$ of the housing 101.

Figure 5:
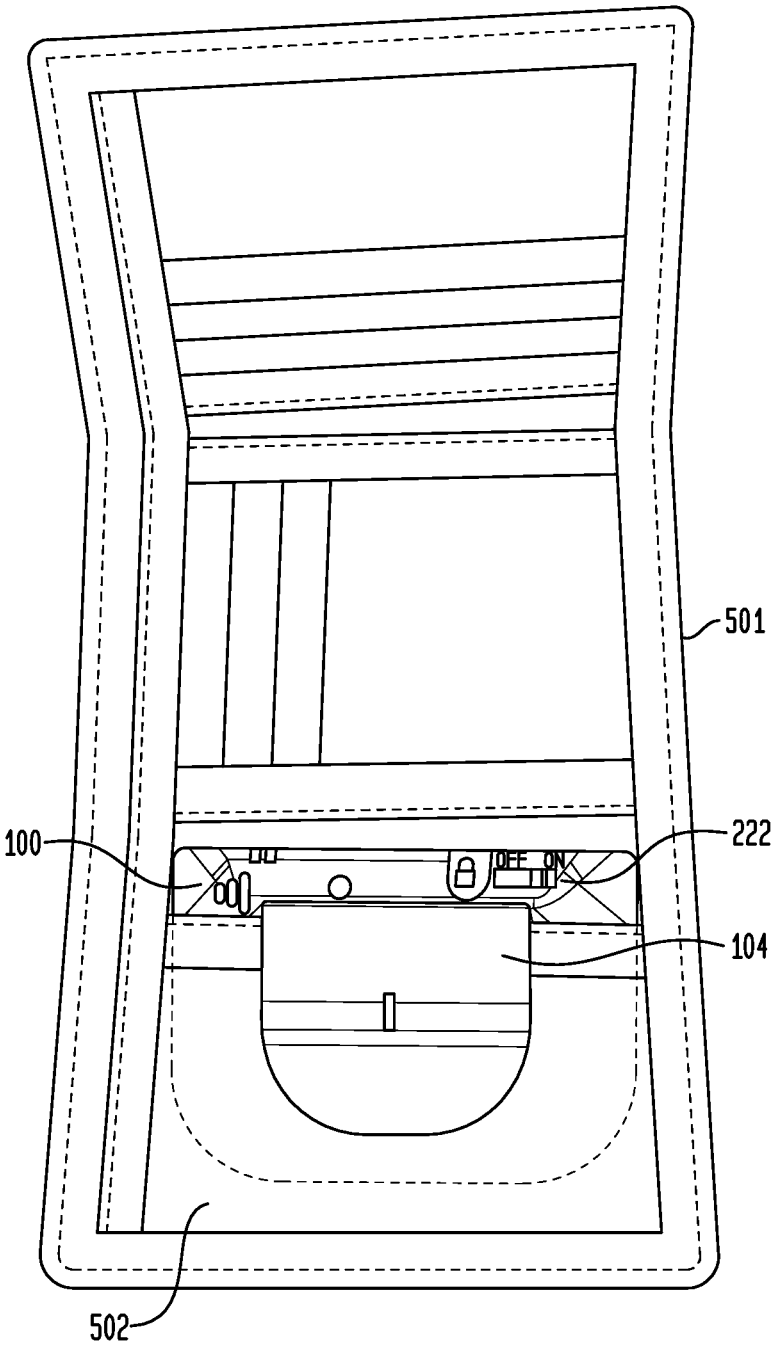
FIG. 5 is an illustration of an armed security device of FIGS. 1A and 1B assembled in a wallet.

The operation of the security device 100 will now be described in connection with FIG. 5. With the power switch 220 in the unarmed position, the security device 100 is inserted into a pocket 502 of a wallet 501 such that the security device housing 101 is mostly inside the pocket, and the clip 104 is entirely outside of the pocket. Inserting the security device 100 into the pocket 502 causes the trigger 242 to be depressed by the inside surface of the pocket 502.

After the trigger 242 is depressed, the security device 100 may be armed by physically moving the slide 222 of the power switch 220 to the ON or armed position, which slides the switch body 221 away from the finger 224 until the finger rests in the recessed portion 210*b* of the switch body, locking the power switch in place. At this point, the security device 100 is armed, and may optionally output a signal indicating that it has been armed, such as the aural alarm 280 emitting a beeping noise or the visual alarm 285 flashing.

If the security device 100 is then removed from the pocket 502 while armed, the inside surface of the pocket would no longer depress the trigger 242, and the trigger spring would expand to bias the trigger out from the housing 101. The trigger 242 moving from the compressed condition to the relaxed condition may be sufficient to activate the device alarm(s) 280/285. Activation of the visual alarm may cause LED 285 to emit a constant or blinking light, while activation of the aural alarm may cause buzzer 280 to emit a sound of at least about 95 decibels. Either one or the other of alarm(s) 280/285 may be activated, or both alarms may be activated together. The signals emitted by the alarms 280/285 in the activated condition will be different from the signals emitted by the alarms in the armed but non-activated condition.

The security device 100 must first be disarmed before it can be removed from the wallet without activating the device alarm(s) 280/285. This may be done by positioning a magnet (not shown) over the unlock indicia 107 on the front cover 102 of the housing 101. The magnet will pull the end portion 224*b* of the metal finger 224 toward the front cover 102 and out of engagement with the edge 223 on the surface 210 of the switch body 221. Once the finger 224 has been acted on by the magnet, the power switch 220 may be slid to the OFF position. Optionally, the expansion of spring 226 may bias the switch body 221 to the OFF position without the exertion of any additional force. After the security device 100 has been disarmed, it can be removed from the wallet 501 without activating the built-in alarm(s) 280/285, even if removal causes the trigger 242 to move from its compressed condition to its relaxed condition. After the security device 100 is removed from the wallet 501, a consumer wishing to purchase the wallet may exit the store without activating an EAS alarm. The security device 100 may then be reused with a new item of merchandise.

Alternatively or additionally, the security device 100 may be disarmed using an infrared scanner (not shown). In such a case, the security device may further include an infrared sensor (not shown) to read a signal output by the infrared scanner. The integrated circuit 250 may then receive and process data from the infrared sensor, and based on the processed information, may disarm the security device.

Figure 6:
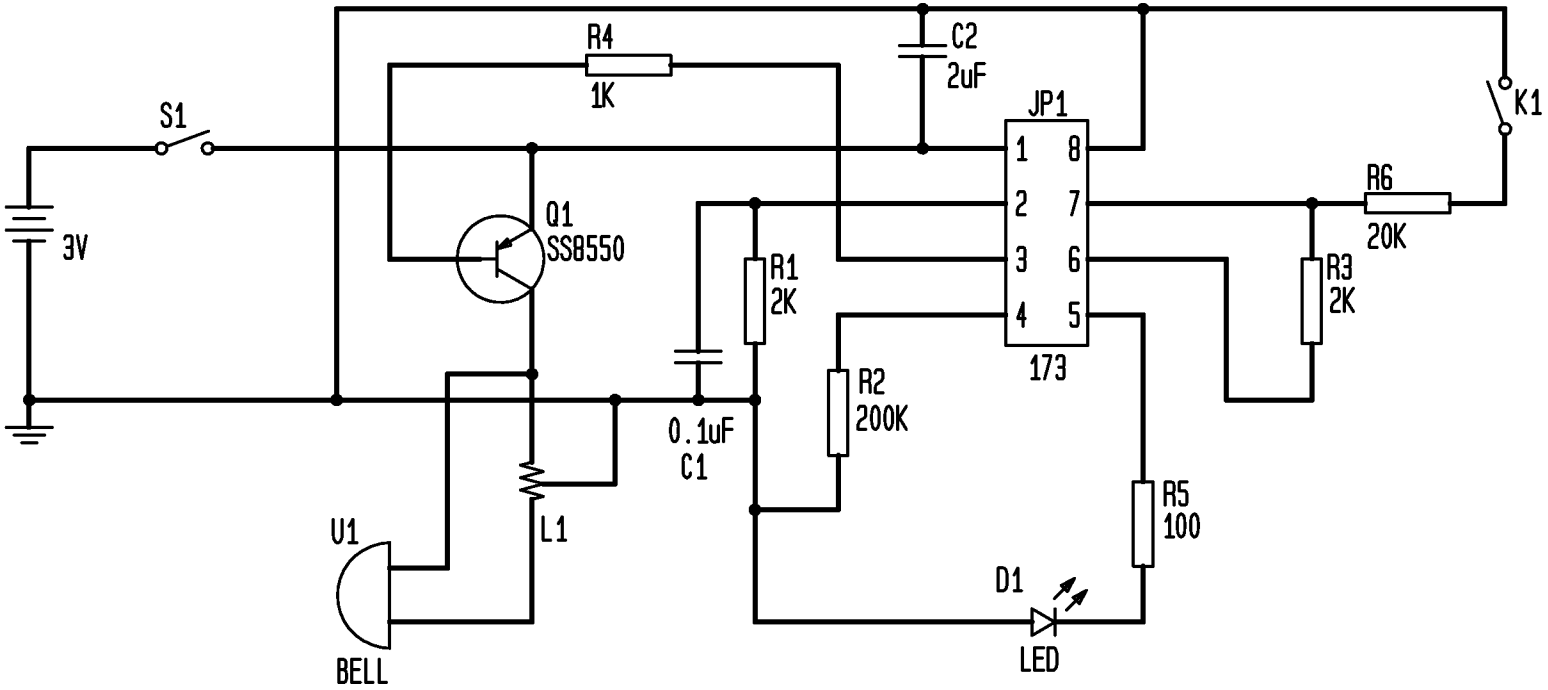
FIG. 6 is a circuit diagram of the security device of FIGS. 1A and 1B.

FIG. 6 is a circuit diagram of the security device 100.

The above generally describes the disarming of the security device 100 before it is removed from the wallet 501. However, it will be readily appreciated that the same principles may be used to deactivate the alarms 280/285 after they have been activated by removing the security device 100 from a wallet or other item of merchandise.

Furthermore, in the above embodiments, the EAS component 290 is not connected to and does not communicate with the integrated circuit 250. However, in other embodiments, the EAS component 290 may be configured to communicate with the integrated circuit 250. For example, the EAS component 290 may be configured to generate an electrical signal when passed through a security gate, and the integrated circuit may be configured to receive the electrical from the EAS component and activate the alarm(s) 280/285 in response to the electrical signal.

The above generally describes an input module including a microswitch. However, it will be readily appreciated that other types of input modules may be utilized. For example, the input module may include a pressure-sensitive switch or pressure sensor, adapted to indicate a force exerted on the switch, such as by a trigger or trigger spring included in a casing of the input module, which force is indicative of how far the trigger is depressed into the casing. A pressure-sensitive switch or pressure sensor may generate one or more electrical signals in response to the sensed force exerted by the trigger or trigger spring, such as an indication of an amount of pressure exerted on the pressure sensor by the trigger spring (e.g., whether the pressure exerted by the trigger spring meets, exceeds or is below a threshold amount). The one or more electrical signals may be received by the integrated circuit, and the integrated circuit may control the alarm based on the received electrical signals. The sensor may be a piezoelectric sensor, a capacitive sensor, or any pressure-measuring sensor known in the art.

As a further example, the input module may include a light sensor, either in place of or in addition to the microswitch or pressure sensor. Where the light sensor replaces the microswitch or pressure sensor, the light sensor may be aligned with the aperture 216 to sense an amount of light passing through the aperture. Where the light sensor is in addition to the microswitch or pressure sensor, the light sensor may sense the light traveling through an additional aperture in the housing 101. In such an arrangement, inserting the security device 100 into the pocket of a wallet causes light to be blocked from entering the aperture. Subsequent removal of the security device from the pocket causes the light sensor to detect an increase in light shining through the aperture, which may result in the activation of the device alarm(s) 280/285 (e.g., if the amount of sensed light meets or exceeds a threshold value), if the device is armed. The light sensor may also double as an infrared sensor for deactivating the security device, as described above.

The above examples also generally describe a security device and housing adapted to fit into a pocket of a wallet. However, it will be readily appreciated that the principles of the present application may be similarly applied to devices that are adapted to fit into or clip onto other retail accessories and/or clothing, such as bags, luggage, briefcases, portfolios, clutches, shoes, boots, and garments, as well as other items of merchandise.

According to a first aspect of the disclosure, a security device for use with an item of merchandise includes a rigid housing having a top cover and a bottom cover, the housing being adapted for insertion into a pocket of the item; an alarm disposed within the housing and configured to generate a human-perceptible alert; and an input module mounted within the housing and configured to indicate whether the security device is outside the pocket of the item, wherein an indication that the security device is outside pocket of the item causes the alarm to generate the human-perceptible alert; and/or the input module may include a pressure sensor and a spring-loaded switch, the switch retracting into the housing when the spring is in a compressed condition, and extending out of the housing when the spring is in a relaxed condition, the spring being in the compressed condition when the housing is in the pocket of the item, and being in the relaxed condition when the housing is outside of the pocket of the item, the pressure sensor may be configured to actuate the alarm in response to the switch moving from the compressed condition to the relaxed condition; and/or the input module may include a microswitch having a spring-loaded trigger, the trigger being retractable into the housing to a retracted condition, and being extendable out of the housing to an extended condition, the trigger being in the retracted condition when the housing is in the pocket of the item, and being in the extended condition when the housing is outside of the pocket of the item, the microswitch may be configured to actuate the alarm in response to the trigger moving from the retracted condition to the extended condition; and/or the housing may include an aperture positioned at a portion of the housing adapted to contact an inner surface of the pocket, the trigger extending through the aperture when the trigger is in the extended condition; and/or the security device may further include a clip mounted on the bottom cover and adapted to secure the security device to the item of merchandise by engaging the item of merchandise between the clip and the back cover, the clip including an aperture aligned with the aperture in the housing, the trigger extending through the aperture in the clip when the trigger is in the extended condition; and/or the sensor may be a light sensor configured to actuate the alarm when an amount of light detected by the light sensor exceeds a threshold value; and/or the light sensor may be disposed within the housing, and the housing may include an aperture positioned at a portion of the housing adapted to contact an inner surface of the pocket, the light sensor being aligned with the aperture to detect light passing through the aperture; and/or the security device may further include a clip mounted on the bottom cover and adapted to secure the security device to the item of merchandise by engaging the item of merchandise between the clip and the back cover, the clip including an aperture aligned with the aperture in the housing, the light sensor being aligned with the aperture in the clip to detect light passing through both the aperture in the housing and the aperture in clip; and/or the alarm may include at least one of an audible alarm and a visual alarm; and/or the security device may further include an electronic article surveillance (EAS) component disposed within the housing, the EAS component being configured to actuate a remote alarm when the device is within a predefined proximity of a security gate; and/or the security device may further include an alarm switch operable to arm the alarm of the security device when in a first switch position, and to disarm the alarm when in a second switch position; and a locking mechanism disposed within the housing and having a first condition in which the locking mechanism locks the alarm switch in the first switch position and a second condition in which the locking mechanism releases the alarm switch to move from the first switch position to the second switch position; and/or the locking mechanism may be moved from the first condition to the second condition by the application of a magnetic force to the locking mechanism; and/or the security device may further include a battery disposed within the housing and operable to provide power to the alarm when the alarm switch is in the first switch position; and/or the security device may further include an integrated circuit operatively coupled to the input module and to the alarm, the integrated circuit being configured to respond to the input module indicating that the security device is outside the pocket of the item by causing the alarm to generate the human-perceptible alert; and/or the security device may further include a printed circuit board disposed within the housing, wherein each of the alarm, the sensor, and the integrated circuit may be mounted on the printed circuit board; and/or the housing may have a thickness of up to 10 millimeters; and/or the housing may have a width of less than 90 millimeters; and/or the housing may have a height of less than 60 millimeters; and/or the item may be selected from the group consisting of a wallet, a bag, or an article of clothing.

According to another aspect of the disclosure, a security device for use with an item of merchandise includes a rigid housing having a front cover and a back cover, the back cover including an aperture therethrough; a clip mounted on the back cover and adapted to secure the security device to the item of merchandise by engaging the item of merchandise between the clip and the back cover, the clip including an aperture aligned with the aperture in the back cover; an alarm disposed within the housing and configured to generate a human-perceptible alert; and an input module disposed within the housing and aligned with the aperture in the back cover, the input module being configured to indicate whether the item of merchandise is unsecured from the security device, wherein an indication that the item of merchandise is unsecured from the security device causes the alarm to generate the human-perceptible alert.

According to yet another aspect of the disclosure, a security device for use with an item of merchandise includes a housing having a top cover and a bottom cover; a printed circuit board mounted within the housing; an aural alarm mounted on the printed circuit board; a transformer mounted on the printed circuit board and operatively coupled to the aural alarm to power the aural alarm; a visual alarm mounted on the printed circuit board; a battery mounted on the printed circuit board and operatively coupled to the transformer and the visual alarm, the battery being adapted to generate sufficient charge to power both the aural alarm and the visual alarm; a trigger module mounted on the printed circuit board, the trigger module including a casing and a spring-loaded trigger enclosed within the casing, the spring-loaded trigger closing an electrical switch when the spring is in a compressed condition and causing the electrical switch to open when the spring is in a relaxed condition, the trigger retracting into the casing when the spring is in the compressed condition and extending out from the casing when the spring is in the relaxed condition; an integrated circuit mounted on the printed circuit board and operatively coupled to the electrical switch to cause activation of the aural alarm and the visual alarm in response to closing or opening of the electrical switch; an arming mechanism movable between an arm position and a disarm position, the integrated circuit being capable of causing activation of the aural alarm and the visual alarm only when the arming mechanism is in the arm position; a locking mechanism disposed within the housing and having a first condition in which the locking mechanism locks the arming mechanism in the arm position and a second condition in which the locking mechanism releases the arming mechanism to move from the arm position to the disarm position; and an electronic article surveillance (EAS) component disposed within the housing and configured to activate a security gate alarm when the device is within a predefined proximity of a security gate; and/or the locking mechanism may be moved from the first condition to the second condition by the application of a magnetic force to the locking mechanism.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A security device for securing an item of merchandise at a sales location, the security device comprising:

a rigid housing having a front cover including a front panel, a back cover including a back panel, and a side edge between the front panel and the back panel, the housing being adapted for insertion into a pocket of the secured item;

an alarm disposed within the housing and configured to generate a human-perceptible alert;

an aperture in the back panel of the housing; and an input module mounted within the housing in alignment with the aperture in the back panel, the input module being configured to receive an input through the aperture indicating whether the security device is outside the pocket of the secured item, wherein the alarm generates the human-perceptible alert when the security device is removed from the pocket of the secured item.

2. The security device of claim 1, wherein the input module includes a pressure sensor and a spring-loaded switch, the switch being positioned in the aperture and retracting into the housing when the spring is in a compressed condition, and extending out of the back panel of the housing when the spring is in a relaxed condition, the spring being in the compressed condition when the housing is in the pocket of the secured item, and being in the relaxed condition when the housing is outside of the pocket of the secured item, the pressure sensor being configured to actuate the alarm in response to the switch moving from the compressed condition to the relaxed condition.

3. The security device of claim 1, wherein the input module includes a microswitch having a spring-loaded trigger, the trigger being retractable into the housing to a retracted condition, and being extendible out of the back panel of the housing to an extended condition, the trigger being in the retracted condition when the housing is in the pocket of the secured item, and being in the extended condition when the housing is outside of the pocket of the secured item, the microswitch being configured to actuate the alarm in response to the trigger moving from the retracted condition to the extended condition.

4. The security device of claim 3, wherein the aperture is positioned at a portion of the back panel of the housing adapted to contact an inner surface of the pocket, the trigger extending through the aperture when the trigger is in the extended condition.

5. The security device of claim 4, further comprising a clip mounted to the housing in a position opposing the back panel of the housing, the clip being adapted to join the security device to the secured item of merchandise by engaging the secured item of merchandise between the clip and the back panel, the clip including an aperture aligned with the aperture in the housing, the trigger extending through the aperture in the clip when the trigger is in the extended condition.

6. The security device of claim 1, wherein the input module includes a light sensor configured to actuate the alarm when an amount of light detected by the light sensor exceeds a threshold value.

7. The security device of claim 6, wherein the light sensor is aligned with the aperture in the back panel to detect light passing through the aperture.

8. The security device of claim 7, further comprising a clip mounted to the housing in a position opposing the back panel of the housing, the clip being adapted to join the security device to the secured item of merchandise by engaging the secured item of merchandise between the clip and the back panel, the clip including an aperture aligned with the aperture in the housing, the light sensor being aligned with the aperture in the clip to detect light passing through both the aperture in the back panel and the aperture in the clip.

9. The security device of claim 1, wherein the alarm comprises at least one of an audible alarm and a visual alarm.

10. The security device of claim 1, further comprising an electronic article surveillance (EAS) component disposed within the housing, the EAS component being configured to actuate a remote alarm when the device is within a predefined proximity of a security gate.

11. The security device of claim 1, further comprising:

an alarm switch operable to arm the alarm of the security device when in a first switch position, and to disarm the alarm when in a second switch position; and a locking mechanism disposed within the housing and having a first condition in which the locking mechanism locks the alarm switch in the first switch position and a second condition in which the locking mechanism releases the alarm switch to move from the first switch position to the second switch position.

12. The security device of claim 11, wherein the locking mechanism is moved from the first condition to the second condition by the application of a magnetic force to the locking mechanism.

13. The security device of claim 11, further comprising:

a battery disposed within the housing and operable to provide power to the alarm when the alarm switch is in the first switch position.

14. The security device of claim 1, further comprising an integrated circuit operatively coupled to the input module and to the alarm, the integrated circuit being configured to respond to the input module indicating that the security device is outside the pocket of the secured item by causing the alarm to generate the human-perceptible alert.

15. The security device of claim 1, wherein the housing has a thickness of up to 10 millimeters.

16. The security device of claim 1, wherein the housing has a width of less than 90 millimeters and a height of less than 60 millimeters.

17. The security device of claim 1, wherein the secured item is selected from the group consisting of a wallet, a bag, and an article of clothing.

18. A security device for securing an item of merchandise at a sales location, the security device comprising:

a rigid housing having a front cover including a front panel, a back cover including a back panel, and a side edge between the front panel and the back panel, the back panel including an aperture therethrough;

a clip mounted to the housing in a position opposing the back panel, the clip being adapted to join the security device to the secured item of merchandise by engaging the secured item of merchandise between the clip and the back panel, the clip including an aperture aligned with the aperture in the back panel;

an alarm disposed within the housing and configured to generate a human-perceptible alert; and an input module disposed within the housing in alignment with the aperture in the back panel, the input module being configured to receive an input through the aperture indicating whether the secured item of merchandise has been removed from the security device, wherein the alarm generates the human-perceptible alert when the secured item of merchandise has been removed from the security device.

19. A security device for use with an item of merchandise, the security device comprising:

a housing having a top cover and a bottom cover;

a printed circuit board mounted within the housing;

an aural alarm mounted on the printed circuit board;

a transformer mounted on the printed circuit board and operatively coupled to the aural alarm to power the aural alarm;

a visual alarm mounted on the printed circuit board;

a battery mounted on the printed circuit board and operatively coupled to the transformer and the visual alarm, the battery being adapted to generate sufficient charge to power both the aural alarm and the visual alarm;

a trigger module mounted on the printed circuit board, the trigger module including a casing and a spring-loaded trigger enclosed within the casing, the spring-loaded trigger closing an electrical switch when the spring is in a compressed condition and causing the electrical switch to open when the spring is in a relaxed condition, the trigger retracting into the casing when the spring is in the compressed condition and extending out from the casing when the spring is in the relaxed condition;

an integrated circuit mounted on the printed circuit board and operatively coupled to the electrical switch to cause activation of the aural alarm and the visual alarm in response to closing or opening of the electrical switch;

an arming mechanism movable between an arm position and a disarm position, the integrated circuit being capable of causing activation of the aural alarm and the visual alarm only when the arming mechanism is in the arm position;

a locking mechanism disposed within the housing and having a first condition in which the locking mechanism locks the arming mechanism in the arm position and a second condition in which the locking mechanism releases the arming mechanism to move from the arm position to the disarm position; and an electronic article surveillance (EAS) component disposed within the housing and configured to activate a security gate alarm when the device is within a predefined proximity of a security gate.

20. The security device of claim 19, wherein the locking mechanism is moved from the first condition to the second condition by the application of a magnetic force to the locking mechanism.

* * * * *